US010080944B1

(12) United States Patent
Bowling

(10) Patent No.: US 10,080,944 B1
(45) Date of Patent: Sep. 25, 2018

(54) BASKETBALL SHOOTING APPARATUS

(71) Applicant: Patrick Bowling, New Haven, KY (US)

(72) Inventor: Patrick Bowling, New Haven, KY (US)

( * ) Notice: Subject to any disclaimer, the term of this patent is extended or adjusted under 35 U.S.C. 154(b) by 19 days.

(21) Appl. No.: 15/289,489

(22) Filed: Oct. 10, 2016

(51) Int. Cl.
*A63B 69/00* (2006.01)
*A63B 63/08* (2006.01)
*A63B 63/00* (2006.01)

(52) U.S. Cl.
CPC ..... *A63B 63/083* (2013.01); *A63B 69/0071* (2013.01); *A63B 2063/001* (2013.01)

(58) Field of Classification Search
CPC ..... A63B 63/083; A63B 69/0071; A63B 2063/001
USPC ..... 473/422, 448, 433, 431, 447; D21/781
See application file for complete search history.

(56) References Cited

U.S. PATENT DOCUMENTS 928,674 A * 7/1909 Lenz ..... A63B 69/0002 473/454
1,924,757 A 8/1933 Shisoff
2,039,794 A * 5/1936 Hayden ..... A63B 63/083 473/448
2,918,283 A 12/1959 Marschalk
3,233,896 A 2/1966 King
4,206,915 A * 6/1980 Woodcock ..... A63B 63/083 473/448
4,667,957 A * 5/1987 Joseph ..... A63B 69/0071 473/433
4,838,549 A 6/1989 Woodall
4,915,380 A 4/1990 Ackerman
4,936,577 A 6/1990 Kington et al.
5,165,680 A 11/1992 Cass
5,312,099 A * 5/1994 Oliver, Sr. ..... A63B 63/083 473/433
5,348,291 A * 9/1994 Scully ..... A63B 63/00 473/454
5,354,048 A * 10/1994 Winesberry, Jr. .... A63B 63/083 473/447
D368,942 S * 4/1996 Mahoney ..... D21/781
5,746,668 A * 5/1998 Ochs ..... A63B 63/083 473/433
5,813,926 A * 9/1998 Vance ..... A63B 63/083 473/433
6,045,463 A * 4/2000 Cass ..... A63B 63/083 473/431

(Continued)

*Primary Examiner* — Mitra Aryanpour
(74) *Attorney, Agent, or Firm* — Middleton Reutlinger

(57) ABSTRACT

A basketball shooting apparatus having adjustable rim members varying the opening through the basketball rim. The basketball shooting apparatus may include one or more portions of a rim portion and/or one or more portions of a floor portion of the apparatus for developing a basketball shooter's form. The rim portion may include the adjustable rim members attached to the basketball rim. The rim members of the rim portion may be combined with one or more other portions of the rim portion to connect to the basketball rim such as at least one of one or more portions of funnel, a lower ring, or a body. The rim portion may also have attachments for a basketball return chute to the floor portion. The floor portion may include a pair of uprights. The floor portion may include one or more alignment guide panels, an abutment member, ball ramp, and/or ball rack.

27 Claims, 6 Drawing Sheets

(56) References Cited

U.S. PATENT DOCUMENTS 6,213,899 B1 4/2001 Maske
6,679,794 B1 * 1/2004 Vitello ..... A63B 69/0057 473/433
D532,476 S * 11/2006 Coryatt ..... D21/701
7,427,244 B1 * 9/2008 Patel ..... A63B 63/083 473/447
7,597,635 B2 * 10/2009 Davies ..... A63B 63/083 473/433
8,162,781 B2 * 4/2012 Heflin, Sr. ..... A63B 69/0059 473/448
8,900,074 B1 * 12/2014 Johnson ..... A63B 69/205 473/422
9,017,188 B2 4/2015 Joseph et al.
2003/0224881 A1 * 12/2003 Vitello ..... A63B 69/0057 473/447
2004/0043841 A1 * 3/2004 Williams ..... A63B 69/0071 473/448
2004/0157685 A1 * 8/2004 Hodges ..... A63B 69/0071 473/448
2005/0192126 A1 * 9/2005 Remaklus ..... A63B 63/08 473/447
2006/0035735 A1 * 2/2006 Baker ..... A63B 69/0071 473/448
2007/0010354 A1 * 1/2007 White ..... A63B 69/0071 473/447
2007/0037638 A1 * 2/2007 Rumfola, III ..... A63B 63/083 473/433
2007/0191142 A1 * 8/2007 Davies ..... A63B 63/083 473/447
2008/0300073 A1 * 12/2008 Krueger ..... A63B 63/083 473/448
2010/0267495 A1 * 10/2010 Heystek ..... A63B 69/0071 473/447
2011/0136594 A1 * 6/2011 Orr ..... A63B 69/0079 473/426
2012/0309566 A1 * 12/2012 Ward, III ..... A63B 69/0071 473/448
2014/0200102 A1 * 7/2014 Frostino ..... A63B 69/0071 473/447
2015/0051023 A1 2/2015 Aipperspach
2015/0165294 A1 * 6/2015 Wackerly ..... A63B 69/0071 473/448
2015/0258404 A1 9/2015 Le
2015/0328518 A1 11/2015 Sagle

* cited by examiner

BASKETBALL SHOOTING APPARATUS

BACKGROUND

The present embodiments relate to a basketball shooting apparatus, and particularly, but not limited to, a basketball shooting apparatus for creating a straight shot line.

Basketball players often have incorrect shooting habits and/or shooting form when shooting a basketball into a basketball rim. Therefore, a need continues to exist in the art to correct and/or teach better shooting form, as well as, generate muscle memory of the proper form.

SUMMARY

In some embodiments, a basketball shooting apparatus may include a floor portion that has a pair of uprights and one or more alignment guide panels. The one or more alignment guide panels may be adjustable in position relative to the pair of uprights. In some embodiments, the apparatus may include a rim portion that has a pair of elongated rim members extending across an opening of a basketball rim and spaced from each other. In addition, the pair of rim members may be adjustable relative to each other to define a first position and a second position across an opening of a basketball rim. In the first position the pair of rim members are a first distance from each other and when in the second position the pair of rim members are a second distance from each other. The second distance may be less than the first distance to vary an area of a basketball rim opening capable of receiving basketball therethrough.

In various embodiments, the pair of uprights may be substantially parallel. In some embodiments, the pair of elongated rim members may be substantially parallel in both the first position and the second position. Further in some embodiments, the uprights of the floor portion may be substantially parallel to the pair of rim members in both the first position and the second position. In addition, in some embodiments, the apparatus may include a basketball return chute between the floor portion and the rim portion, and the floor portion may have a spool to wind or unwind a portion of the basketball return chute. In some embodiments, the rim portion may include at least one of a body, a funnel, a lower ring, or depending chute attachments. Further in various embodiments, the floor portion may include an abutment member between the uprights away from the rim portion whereby limiting downward basketball movement and the start of upward shooting motion. Further the abutment member may be adjustable upwardly or downwardly. In addition, the abutment member may be a flexible member. In various embodiments, the pair of rim members may be flexible cords.

Further, in some embodiments the basketball shooting apparatus for a basketball rim defining a rim opening may include a floor portion that may have a pair of uprights and one or more alignment guide panels. In some embodiments, the apparatus my include a rim portion that has an arcuate body defining an opening in a first plane therein and a first rim member and a second rim member projecting into the opening and adjustable along a direction within the first plane. The first rim member may include an interior surface and the second rim member may include an interior surface each towards a central axis of the opening. In various embodiments, the interior surfaces may be spaced relative to each other in each one of a first position and a second position along the direction. Further in the first position, the interior surface of the first rim member may be a first distance from the interior surface of the second rim member and wherein in the second position the interior surface of the first rim member may be a second distance from the interior surface of the second rim member. In addition in some embodiments, the first distance may be larger than the second distance.

In addition, in some embodiments, the pair of uprights may be substantially parallel and the interior surfaces may be spaced in a substantially parallel orientation relative to each other. Further, the uprights may be substantially parallel to the first rim member and the second rim member in both the first position and the second position. In various embodiments, the apparatus may include a basketball return chute between the floor portion and the rim portion. Further, the floor portion may include a spool to wind or unwind a portion of the basketball return chute. In addition, the basketball return chute may include at least one of loops, ties, and eyes to secure to the floor portion at a variety of distances from the rim portion. In various embodiments, the rim portion may further include at least one of a funnel, a lower ring, or depending chute attachments. In some embodiments, the floor portion may include an abutment member between the uprights in a direction away from the rim portion whereby limiting downward basketball movement and the start of upward shooting motion. Further in some embodiments, the apparatus may include a ball ramp above the abutment member. Further, the ball ramp may be adjustable upwardly and downwardly. In some embodiments, the ball ramp may be pivotable relative to the abutment member. In various embodiments, the abutment member may be adjustable upwardly and downwardly. In some embodiments, the abutment member may be a flexible member. In addition, in some embodiments, the uprights angle towards the abutment member away from the rim portion. In various embodiments, the first rim member and the second rim member may be one or more flexible cords.

In various embodiments, the basketball shooting apparatus may include a floor portion having a pair of uprights and one or more alignment guide panels. In some embodiments, the apparatus may include a rim portion that has an arcuate body defining an opening therein. Further, the arcuate body may have a pair of opposing elastic cords on opposing sides of a center plane. In addition, the opposing elastic cords may be adjustable relative to the center plane between a first position and a second position. When in the first position each respective opposing end of the elastic cord may be secured to the arcuate body and define opposing first circular sections on opposing sides of the center plane. When in the second position, each respective opposing end of the elastic cord is secured to the arcuate body and define opposing second circular sections on opposing sides of the center plane. Further in some embodiments, the first circular section may have a smaller area than the second circular section.

In some embodiments, the pair of opposing elastic cords are substantially parallel in at least one of the first position and the second position. Further in some embodiments, the rim portion may be releasably secured to a basketball rim. In addition, in some embodiments, the arcuate body may include a plurality of attachments, wherein the opposing ends of the elastic cords may be releasable secured to at least one of the plurality of attachments in either one of the first position or the second positions. In various embodiments, the apparatus may include a basketball return chute between the floor portion and the rim portion. In additional embodiments, the floor portion may further include an abutment member adjustable upwardly and downwardly relative to the uprights. Further, the uprights may angle towards the abutment member away from the rim portion. In various embodiments, the rim portion may include at least one of a funnel projecting upwardly from the arcuate body of the rim portion, one or more depending attachments for a basketball return chute, or a lower ring interconnecting one or more portions of the arcuate body.

These and other advantages and features, which characterize the embodiments, are set forth in the claims annexed hereto and form a further part hereof. However, for a better understanding of the embodiments, and of the advantages and objectives attained through its use, reference should be made to the Drawings, and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

Figure 1:
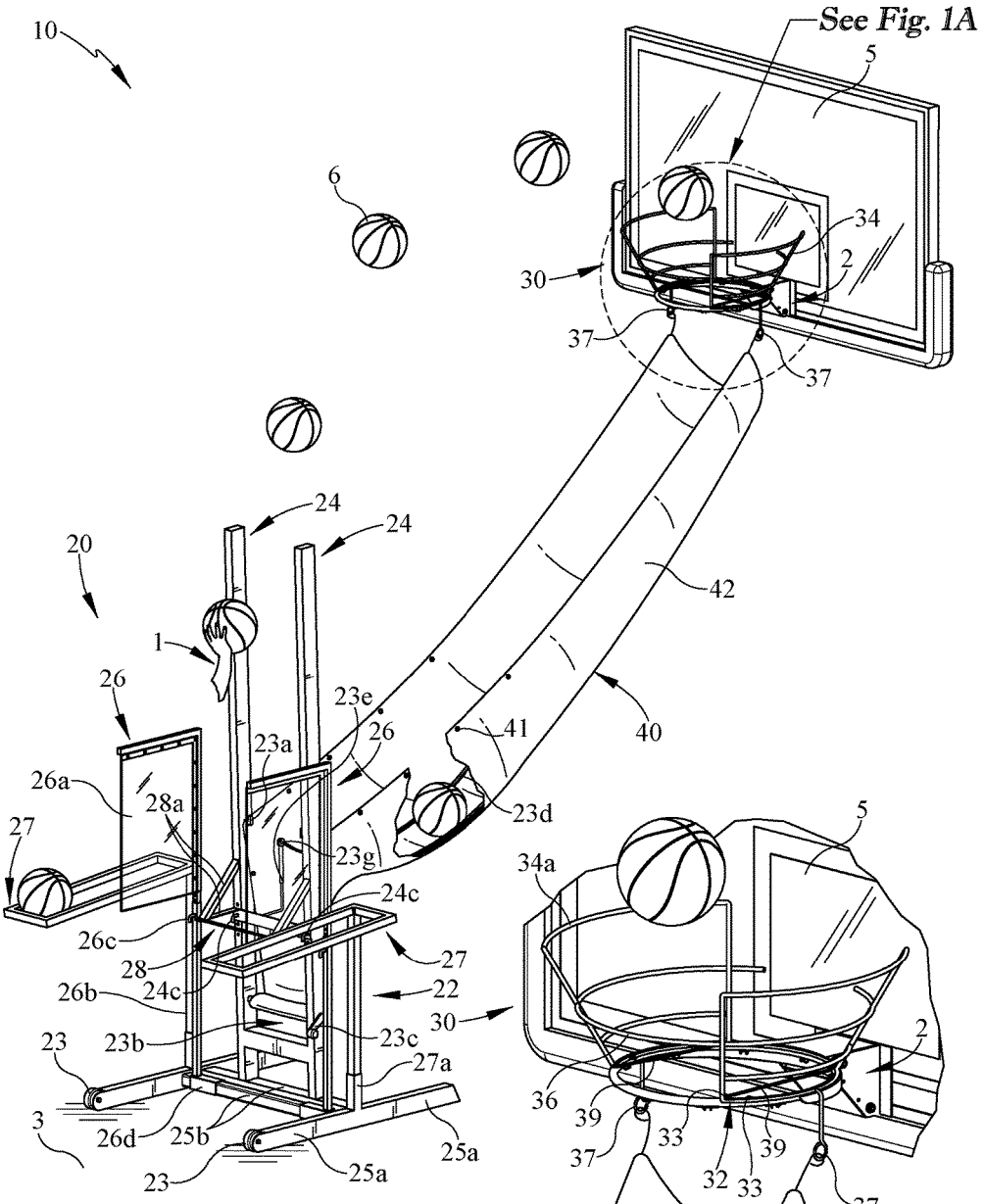
FIG. 1 is a perspective view of one embodiment of a basketball shooting apparatus, with portions of a basketball return chute broken away illustrating a ramp.
Figure 1A:
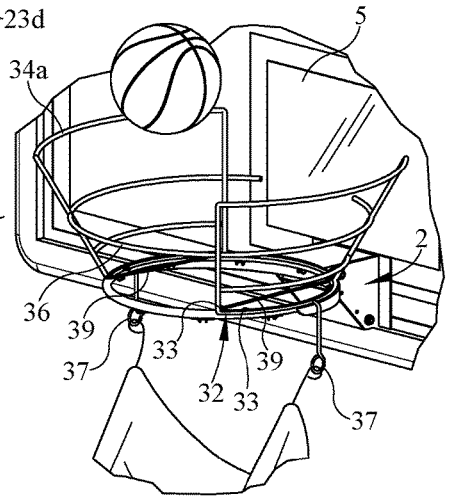
FIG. 1A is an enlarged perspective view of one embodiment of a rim portion of the basketball shooting apparatus of FIG. 1.
Figure 2:
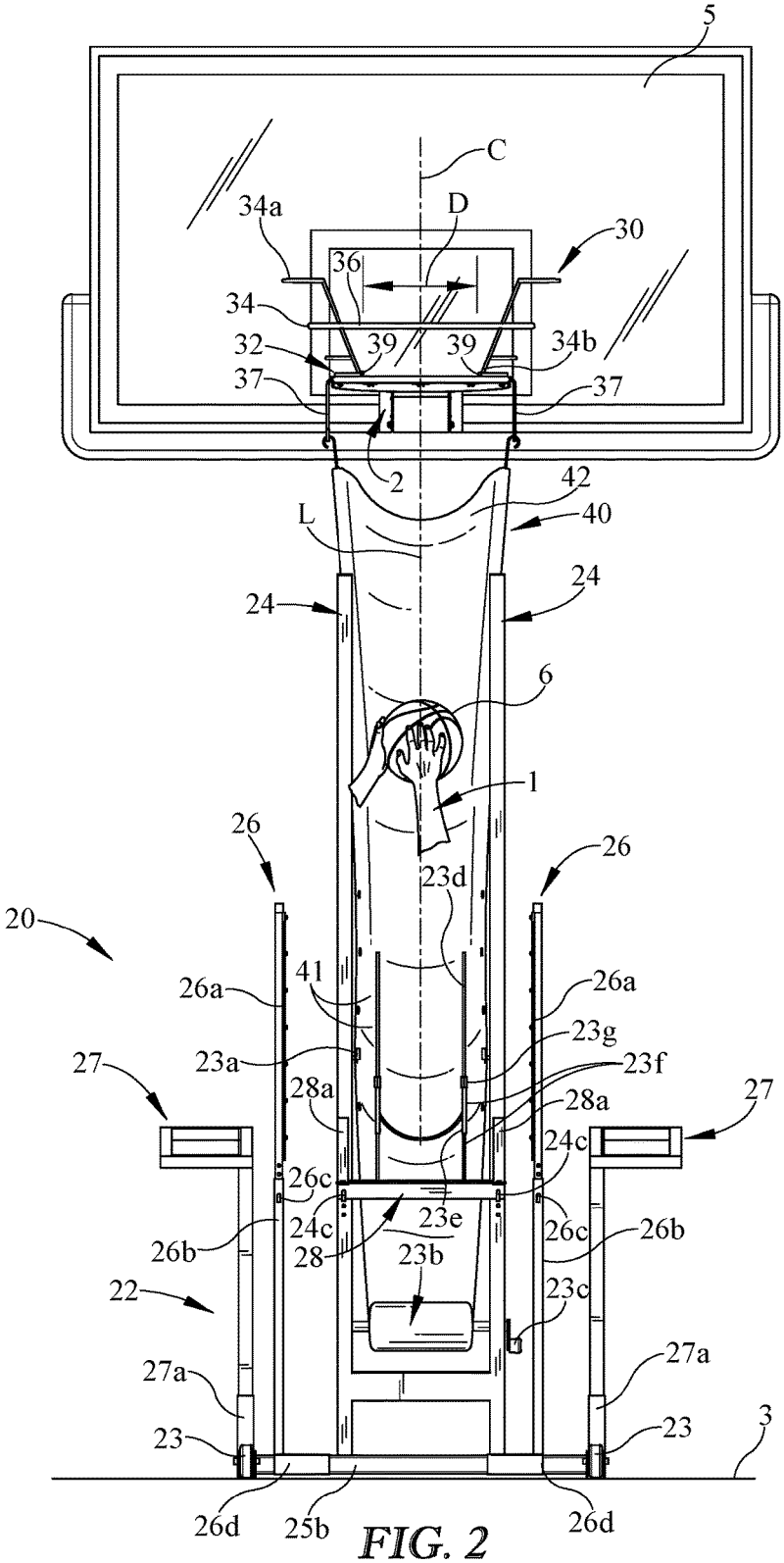
FIG. 2 is a front view of the embodiment of FIG. 1 illustrating a straight shot line to the center of the basketball rim mounted on a backboard.

Turning now to the drawings, wherein like numbers denote like parts throughout the several views, FIG. 1 illustrates an example basketball shooting apparatus 10 in which the technologies and techniques described herein may be implemented. The shooting apparatus 10 is an adjustable shooting aid for a basketball shooter 1 to develop a straight shot line L from the shooter to the central axis Ac or center plane C of a basketball rim 2. The center plane C passes through the central axis Ac of the rim opening 4 at different orientations of the straight shot line L corresponding to the shooting angle or orientation of the basketball shooting apparatus 10 relative to the basketball rim 2. The apparatus 10, or portions thereof, may be setup and moved between various floor 3 or basketball court positions and orientations relative to the basketball rim to practice at variety of shot locations, e.g., free-throw line, along the three point line, inside the paint, various angles relative to and distances from the basketball rim 2, or the like. The embodiments discussed hereinafter will focus on the implementation of the hereinafter-described shooting apparatus 10, such as the type that may be used by a number of users of various levels of skill in a variety of basketball applications, such as residential courts, gymnasiums, practice courts, various rim heights, or in other similar applications or facilities.

As shown in the figures, the basketball shooting apparatus 10 may include a floor portion 20 adjacent the shooter and/or a rim portion 30 adjacent the basketball rim 2 to create a straight shot line L to the basketball rim 2. The rim portion 30 may be releasably secured to the basketball rim 2, as well as, may be rotatable or orientated at different angles about the central axis Ac of the rim opening 4 of the basketball rim 2 corresponding to the desired shooting angle relative to the basketball rim 2. The floor portion 20 is positioned on the basketball court at the desired distance and angle relative to the basketball rim 2. In the embodiment shown, the basketball shooting apparatus 10 is positioned straight from the front of the basketball rim 2 or perpendicular from the backboard 5. If used, a basketball return chute 40 may be used to connect the rim portion 30 to the floor portion 20 to return the basketball 6 back to the proximity of the basketball shooter 1 adjacent the floor portion 20. The basketball return chute 40 may be adjusted in length, e.g., lengthened and/or shortened, to extend the varying distances between the floor portion 20 and the rim portion 30 of the basketball shooting apparatus 10.

In the one embodiment shown, the floor portion 20 of the basketball apparatus may include a base or framework 22 having at a pair of parallel uprights 24 projecting upwardly from the floor 3. The base 22 or portions thereof may be, but not limited to, tubular metal, wood, and/or plastic. The base 22 may include one or more wheels 23 to assist in moving the floor portion 20 between positions, e.g., between various shooting positions on the basketball court and/or into or out of storage. The wheels 23 may also have locks to releasably fix the position of the floor portion 20 relative to the floor 3. The base 22 may include one or more lateral feet members 25*a* extending outwardly from one or more connecting members 25*b* therebetween that create a footprint that may contact, balance, or distribute the load across the surface area of the floor 3 or court. In the embodiment shown, wheels 23 are placed on the free ends of the lateral feet members 25*a* to allow the user to tilt the floor portion 20 onto the wheels 23 and relocate, and subsequently tilt back to the shooting orientation with the parallel uprights in a perpendicular plane relative to the center plane C passing through the central axis Ac of the basketball rim 2.

Figure 3:
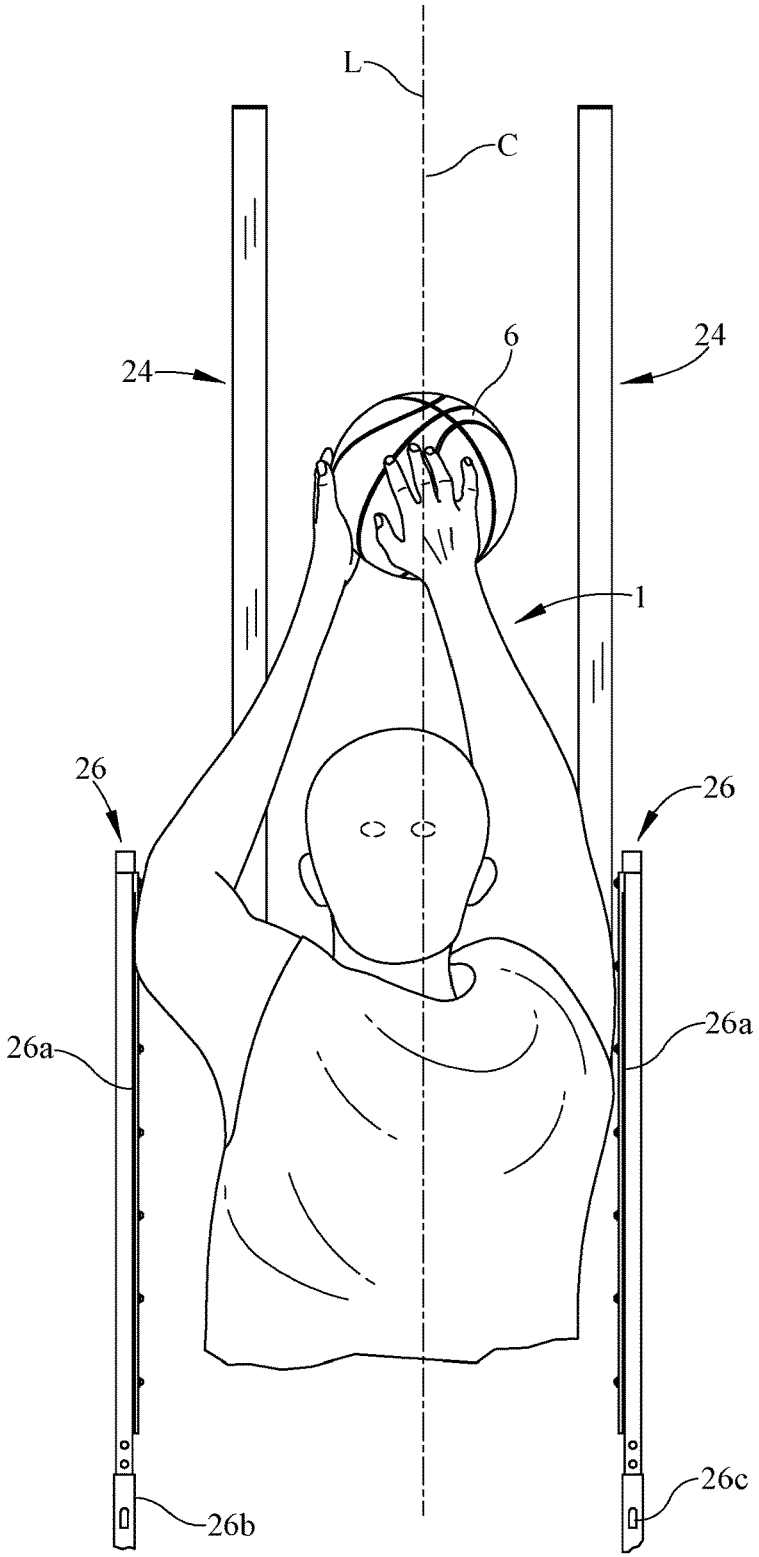
FIG. 3 is an enlarged front view of the embodiment of FIG. 1 illustrating the straight shot line and alignment guide panels aligning the shooter to the proper position between the uprights.
Figure 4:
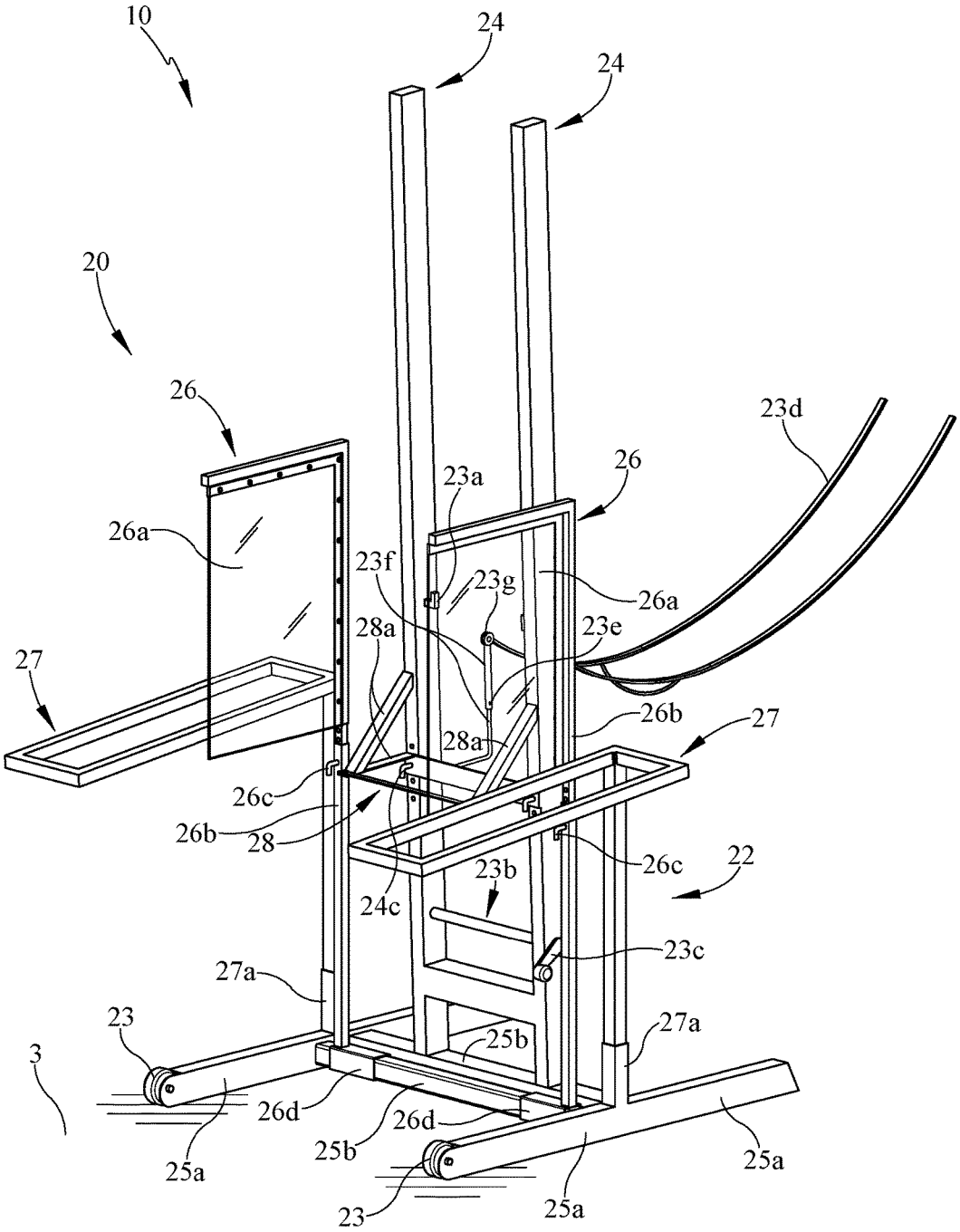
FIG. 4 is an enlarged perspective view of the floor portion of the embodiment of FIG. 1.

One or more shot line alignment guide panels 26 may be adjustable to restrict the movement of the shooter 1 during the shot process. Each one of the alignment guide panels 26, alone or together, may be adjusted vertically to allow for varying heights of the shooter 1 and/or laterally to position the shooter's shooting eye and basketball 6 along the straight shot line L. Lateral movement of one or more of the alignment guide panels 26 relative to the uprights 24 may allow for varying widths of the shooter 1 as well. The alignment guide panels 26 may be locked in their respective vertical and/or horizontal positions. At least one of the alignment guide panels 26 may be slid laterally inwardly and/or outwardly relative to the shooter 1 to a desired position. As shown in FIG. 3, the alignment guide panels 26 may position the shooter in his correct shot line such that their shooting or aiming eye is substantially centered between the parallel uprights 24. With the shooter's shoulders abutting the alignment guide panels 26, the shooting eye may be centered between the uprights 24 into its proper position corresponding to the relative shooting hand. In addition, the alignment guide panels 26 may also keep the shooter's elbows in. Further in some embodiments, a panel 26*a* may be used and positioned upwardly and/or downwardly to a position relative to the shooter to restrict the shooter during the shooting process. For example, the alignment guide upright may have a telescoping vertically extending arm 26*b* positioning the panel 26*a* into a vertical position relative to the shooter 1. The panel 26*a* may be glass, Lexan, plywood, etc. A see-through panel 26*a* may allow a coach or spectator to watch and critique the shooter during the shooting process. A locking mechanism, e.g., such as a pin 26*c*, may be inserted into one or more openings of the telescoping arm 26*b* to fix the vertical position of the alignment guide panel 26. Further, the telescoping arm 26*b* may be connected to a sleeve 26*d* extending about at least a portion of the connecting member 25*b* to allow sliding movement to a lateral position relative to the shooter 1. The sleeve 26*d* allows one or more alignment guide panels 26 to laterally slide or move along connecting member 25*b* to a desired position relative to the uprights 24. By sliding the one or more alignment guide panels 26, left and/or right, the right or left handed shooter can be positioned to their proper shot line. As shown in FIG. 3, the right handed shooter 1 has the alignment guides moved lateral to the left to position the shooter and thus the shooter's right eye to center or align along the shot line L created between the uprights 24. Alternatively, it should be understood that the one or more alignment guides 26 may be slid to the right relative to the uprights 24 to properly position a left handed shooter's left eye along the shot line L.

It should be understood that one or both of the alignment guide panels 26, if used, may be used to restrict a one or both lateral movements of the shooter 1 depending on the basketball shooting skill or process. For example, one alignment guide panel 26 could be removed to allow passing from the left or right to the shooter 1, dribbling into position straight back from the uprights 24, left, and/or right, or the like. Further examples, one or more alignment guide panels 26 when in use may be used to simulate a screened shot upon the shooter 1 moving around the alignment guide panels 26 to the position within the uprights 24 and shoot. One or more basketball racks 27 may be included in the base 22 of the floor portion 20. The basketball racks 27 as shown may be on the outside of the alignment guide panels 26, however the racks 27 may be on the inside or possibly in the front of the uprights 24 towards the basketball rim 2. The basketball racks 27 may be removable from a base receiving members or structure 27*a*. Alternatively, the basketball racks 27 may be non-removable.

As shown in FIGS. 1-5, the floor portion 20 may include a pair of substantially parallel uprights 24 extending upwardly from a portion of the base 22 or floor 3. The pair of parallel uprights 24 extend upwardly in a direction away from the floor 3 and provide restriction of movement of the shooter 1 in the plane perpendicular to the center plane C at the relative angle to the central axis Ac of the rim 2, e.g., the hands and basketball 6 stay within the lateral bounds of the parallel uprights 24 for at least a portion of the ball movement to track the straight shot line L. The hands and basketball 6 may also be within the uprights 24 during the release of the shot to maintain the straight shot line L towards the center or central axis Ac of the basketball rim 2. In the embodiment shown, the substantially parallel uprights 24 extend from the connecting members 25*b*, for example another connecting member 25*b* towards the rim 2 different from the connecting member 25*b* slidingly engaging the sleeves 26*d* of the alignment guide panels 26. The panels 26*a* extend away from the uprights 24 in a direction away from the basketball rim 2, or towards the shooter 1. The distance or width between the parallel uprights 24 are substantially sized to allow a clearance for the ball and respective guide hand to pass upwardly therethrough with reduced lateral movement relative to the straight shot line L. Although the uprights 24 may extend substantially perpendicular to the floor 3, in some embodiments as shown more clearly in FIG. 5 the parallel uprights 24 may be angled away from basketball rim 2 or towards the alignment guide panels 26, shooter position, and/or front of the floor portion 20. This angle may maintain the ball and guide hand substantially between the uprights 24 during the shooter's interaction with the basketball 6 before release. The angle $\alpha$ may be, but is not limited to, between 5 and 30 degrees from the vertical or perpendicular axis relative to the plane of the floor 3, preferably 10 to 20 degrees. The parallel uprights 24 may extend upwardly in height for a variety of distances to capture the release point of the basketball 6 from the shooter's hands.

As shown in the figures, the base 22 of the floor portion 20 may include an abutment member or signal device 28 to signal to the user that the ball 6 is moved to a specific downward position within the shot process. The abutment member 28 may at least partially obstruct or limit the downward basketball movement to signal to the shooter to start upward shooting movement by providing a variety of resistances in the downward direction. For example, the abutment member may be a flexible or rigid to provide a variety of resistances when reached with the ball. The repetition of the ball position when brought to the abutment member may aid in muscle memory as to where the shooter starts the shot at a lower point. The abutment member 28 may be adjusted vertically to correspond to the height of the shooter 1 such that the ball starts in a general area below the shooter's waist when contact is made with the abutment member 28. In the embodiment shown in the figures, the abutment member 28, e.g., a flexible member or cord, extends between two opposing members 28*a* extending towards the shooter 1 from each respective upright 24. When the shooter 1 dips the basketball 6 downwardly to the abutment member 28, the obstruction, resistance, or variety of other signals indicate to the shooter 1 that the ball 6 has traveled to the starting point of the shot.

The signal to the shooter when the lower position is reached may be one or more of a touch, audible, and/or visual feature. For example, the signal to the shooter 1 at the abutment member 28 may be a visual indicator such as a light and/or audible noise to indicate proper form and position of the ball during the shot process. The abutment member 28 may be made of steel, cloth, plastic, rubber, elastic cord, etc. to provide flexible and/or nonflexible characteristics. Although the abutment member 28 is shown in detail in the drawings, it is merely representative of some embodiments, and it is to be understood that there are a variety of shapes, sizes, orientations, constructions, and quantities which may be used and still be within the scope of the teachings herein. For example, an audible click or ding of a bell may signal the ball reaches the desired position or start position. Further by example, the ball 6 may interrupt a laser at the downward extent to trigger an audible signal.

One embodiment of the rim portion 30 of the basketball shooting apparatus 10 is shown in the figures. The rim portion 30 may include a body 32 releasably attached to the basketball rim 2. The body 32 may be arcuate in shape to substantially align with portions of the basketball rim 2. In some embodiments, the body 32 may be discontinuous about the circumference of the rim. The body 32 may define an opening 38 overlaying the rim opening 4 of the basketball rim. The body 32 may or may not obstruct a portion of the rim opening 4 when attached. The rim portion 30 may have a funnel 34 extending at least partially about the periphery of the body 32 and basketball rim 2. The distal portion 34*a* of the funnel 34 spaced from the rim 2 may be a larger circumference than the proximal portion 34*b* adjacent the rim 2. The funnel 34 helps direct the ball 6 through the basketball rim 2 on missed shots, this may assist on returns to the shooter 1 at the floor portion 20. A lower ring 36 positioned between the body 32 and the distal portion 34*a* of the funnel 34 may be orientated above and outwardly from the front of the basketball rim 2 and/or towards the shooter 1. The lower ring 36 provides an obstruction and visual reference to the shooter to assist in teaching appropriate arc or ball travel. The lower ring 36 may be about 45 degrees, above and away from the periphery of the basketball rim 2 in the direction of the shooter such that the user shoots over the lower ring 36 and may reduce the likelihood of hitting the back of the rim. The body 32 of the rim portion 30 may be attached to the basketball rim 2 with loops, ties, straps, U-bolts, rubber mounts, or the like at a variety of rotational positions about the central axis Ac to align with the variety of shooting angles towards the rim 2. Depending attachments 37, e.g., such as eyelets, on the opposing lateral sides of the rim portion 30 or body 32 may be included to releasably secure the basketball return chute 40.

Figure 6:
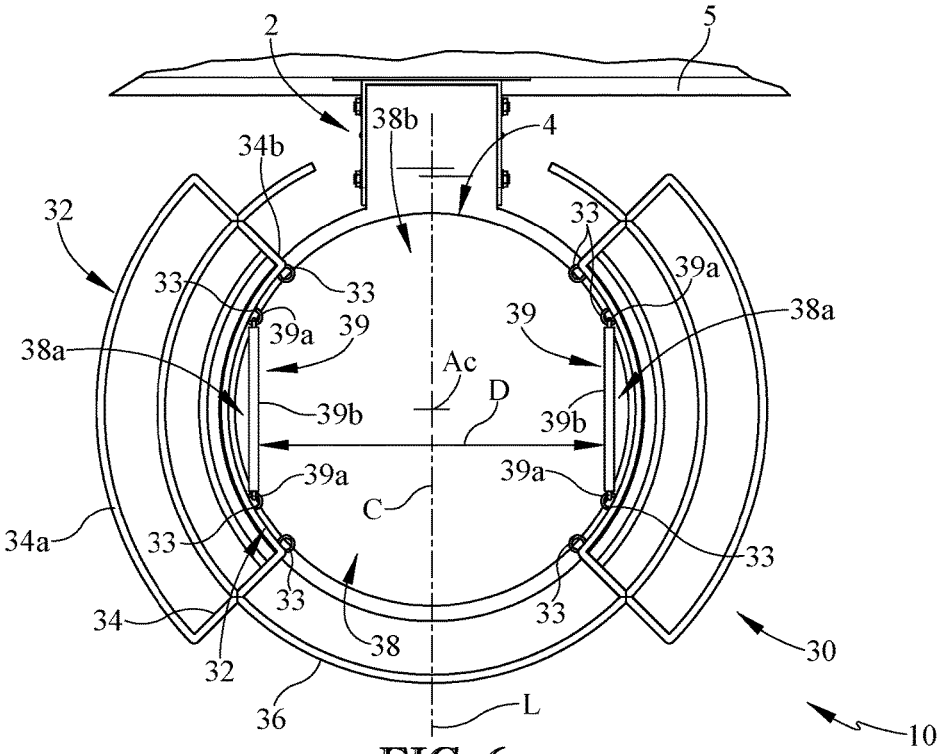
FIG. 6 is a top view of the rim portion of the embodiment of FIG. 1 illustrating a pair of rim members extending across the opening of the basketball rim in a first position on opposing sides of the center of the basketball rim.
Figure 7:
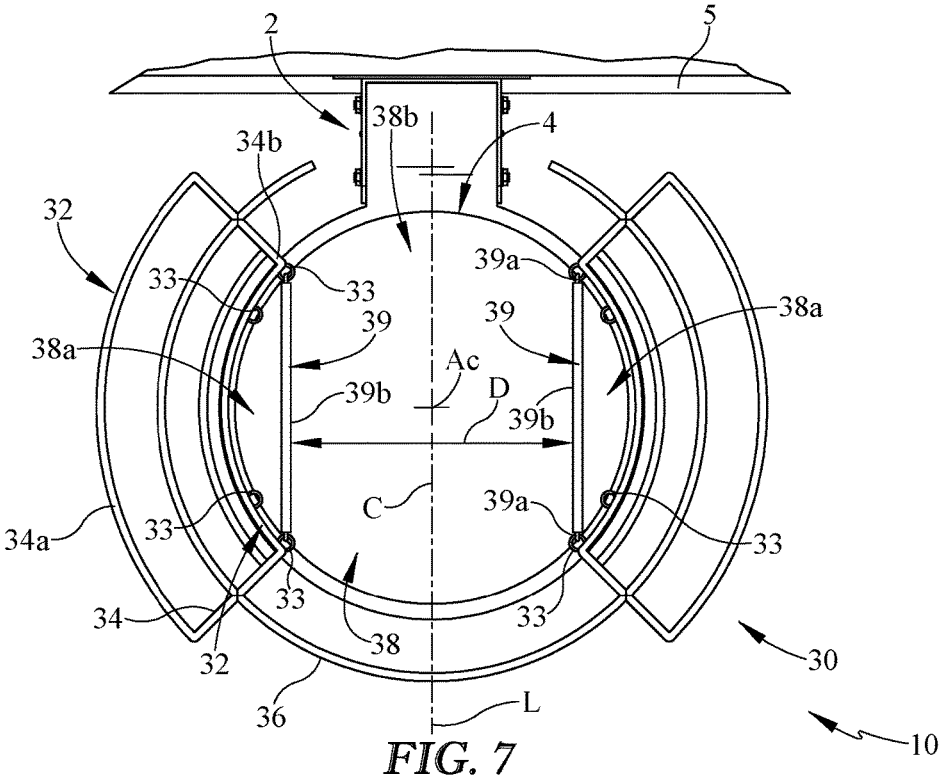
FIG. 7 is a top view of the rim portion of the embodiment of FIG. 1 illustrating the pair of rim members extending across the opening of the basketball rim in a second position on opposing sides of the center of the basketball rim narrowing the through opening.

Further, the body 32 of the rim portion 30 may have a pair of rim members 39 adjustable relative to each other to narrow or widen the opening 38 defined by the body 32 through the rim opening 4 of the basketball rim 2. These elongated rim members 39 are substantially parallel to each other in a first position (FIG. 6) and a second position (FIG. 7) and extend across the rim opening 4 of the basketball rim 2. The rim members 39 extend substantially in a horizontal plane such that the rim members may extend perpendicular to the central axis Ac of the rim opening 4. The width or distance D between the rim members 39 in the first position is larger than distance between the rim members in the second position. As a result the area that a ball 6 can pass through is reduced when adjusted from the first position to the second position. Further, each respective parallel rim member 39 when in the first position and second position may be substantially equidistantly spaced from the central axis Ac. In some embodiments as shown, the respective ends 39*a* of the elongated rim members 39 may each connect to the body 32 in their respective positions, e.g., such as hooks, tied, clips, or the like. However, one or more ends 39*a* of the rim members 39 do not have to connect to the body 32 because it should be understood that other portions of the rim member may be connected to the body 32 or other similar configurations and still be within the teachings herein. Further, each end of the rim members 39 may releasably attach to an attachment 33 of the body 32 at each respective first position (FIG. 6) and second position (FIG. 7). The attachment 33 may be one or more rings or eyelets of the body 32. The opening 38 is successively narrowed from the first position (FIG. 6) to the second position (FIG. 7) to teach the shooter to focus on the narrower rim opening 4 that a ball can pass through as of a result of the rim portion. As such, the successively narrowing of the rim opening 4 results in an area defined by the circular section 38*a* or cut-off area of the circular rim opening 4 increases between the first position to the second position. These circular sections 38*a* are the opposing sections on each side of the center plane C or axis Ac, which the ball 6 cannot pass through, and defined or outlined by the rim members 39 and the arc defined by the ends or bounds of the rim members 39. Correspondingly, the area of the through opening 38*b* defined by an interior surface 39*b* or bounds of the rim members 39 and remaining portions of the rim 2 or body 32 circumference decrease when rim members are adjusted between the first position and the second position. With practice the shooter 1 may successively switch from a rim portion 20 without rim members 39, a first position with rim members 39, and then to the second position with rim members 39 to increase difficulty as well as increase the skill of shooting straight along the straight shot line L. It should be understood that the body 32 may or may not also reduce the rim opening 4 area or size such as when rim members are not used. The rim members 39 may be rigid such as rods or flexible such as flexible or elastic cords. For example, the same elastic cord that fits between the outer pair of attachments 33 in the first position may be stretched to fit in the corresponding inner pair of attachments 33 of the second position.

As illustrated in the Figures, the parallel rim members 39 of the rim portion 30 in both the first and second positions may be substantially parallel to the substantially parallel upright members 24 of the floor portion 20 to create a straight shot line L for the shooter 1. Guiding the shooter and/or ball along the straight shot line L may be from the floor portion 20 through the substantially parallel uprights 24 and through to the rim portion 30 having the parallel rim members 39 defining the through opening 38*b* relative to the center of the rim 2. As such the floor portion and the rim portion may interact with the shooter and/or ball during the shooting process to focus on the straight shot line L at the beginning, during, and/or end of the shot. It should be understood that when the parallel uprights 24 of the floor portion 20 are moved to another location upon the floor 3 the corresponding parallel orientation may be applied to the rim members 39 or rim portion 30 to achieve the straight alignment therebetween. Although the rim members 39 and/or body 32 is shown in detail in the drawings, it is merely representative of some embodiments, and it is to be understood that there are a variety of shapes, sizes, orientations, constructions, and quantities which may be used and still be within the scope of the teachings herein. For example, the rim members 30 may define a variety of through openings 38*b* sizes and shapes in one or both of the first and second positions. As such the outline of the through openings 38 may be dissimilar in the first and second positions. Further for example, a first rim member may be used between the outer pair of attachments and a second rim member may be used between the inner pair of attachments. Further, rim members in the first position may be fixed and another set of rim members in the second position may be removable. It should be understood that in some embodiments, the rim members in one or more of the positions do not have to be substantially parallel to each other. Further in some embodiments, the uprights 26 do not have to be substantially parallel, nor parallel to the rim members in one or more of their various positions such as the first and second positions.

Figure 5:
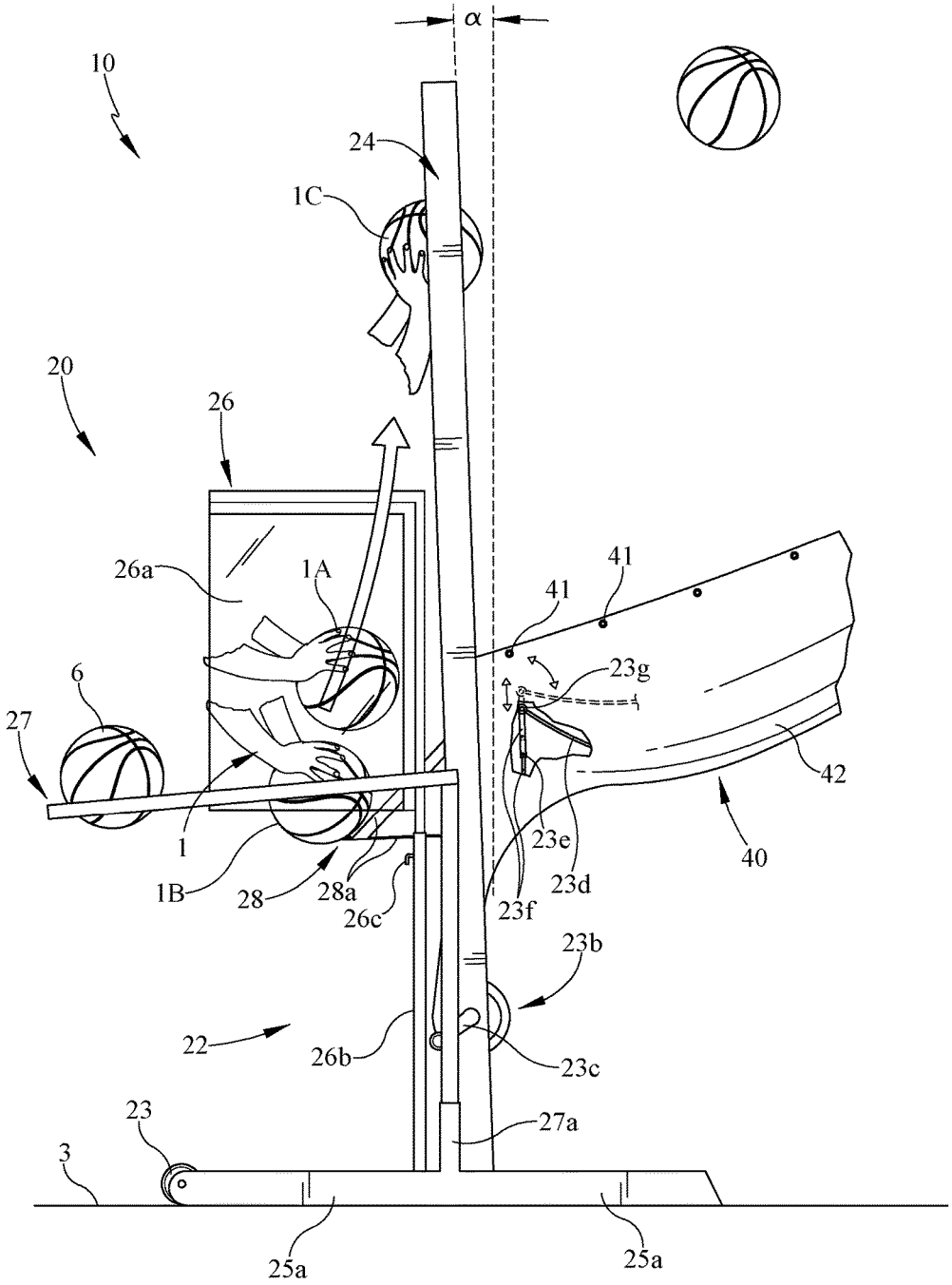
FIG. 5 is s side view of the floor portion of the embodiment of FIG. 1 with portions of the basketball return chute broken away.

The figures illustrate that a basketball return chute 40 may be used to connect the rim portion 30 to the floor portion 20 to return basketballs 6 to the shooter at the floor portion 20. The basketball return chute 40 may be attached to the depending attachments 37 of the rim portion 30 by string, cable ties, rings, etc. and be varied in length to the floor portion 20. A plurality of eyes, loops, ties, hooks, attachments 41 may run along the upper free ends of the net 42 and may be attached to the parallel uprights 24 at connectors, such as pegs 23*a* above the abutment member 28 at the desired length of the shot to be practiced to create a straight and/or tight net. If used, a spool 23*b* may be operated to adjust, wind or unwind, the length of the net, reel extra net length in or out via a crank handle 23*c*. In some embodiments, a ball ramp 23*d* may be included in the floor portion 20, or more specifically projecting from between the parallel uprights 24, within the net 42. The ball ramp 23*d* lays in the bottom of the net 42 and ramps the ball above the shot pocket or abutment member 28. The ball ramp 23*d* is narrower than a basketball, so when the ball rolls down the net 42 and gets to the ramp it is ramped out of the net to the shooter 1. Ramp 23*d* teaches the shooter 1 to catch above the abutment member and dip the ball to the abutment member 28 to then start upward movement. As shown in FIG. 5, the ball ramp 23*d* directs the ball 6 out of the net 42 and to the shooter 1 above the abutment member 28 at position 1A. With the ball 6 delivered by the ramp 23*d* above the shooter's 1 waist and above the abutment member 28 at position 1A, the shooter 1 may dip or bring the ball lower to the start position 1B by making contact with the abutment member and start upward shooting motion. The shooter subsequently continues to release the shot at another position 1C though the parallel uprights 24.

In some embodiments as shown, the abutment member 28 and/or the ball ramp 23*d* may be adjusted vertically. The abutment member 28 and ball ramp 23*d* may be connected together such that they may be raised and/or lowered together. In some embodiments a locking mechanism, e.g., such as a pin 24*c*, may be inserted into one or more openings between the uprights 24 and abutment members/ramp to fix the vertical position of the abutment member and/or ball ramp 23*d* relative to the uprights 24. Thereby vertical adjustment via pin 24*c* relative to the uprights 24 may move the abutment member 28 and the ball ramp 23*d* between vertical positions to adjust to the height of the shooter or place the ball to desired positions relative to the shooter. In addition in some embodiments, the ball ramp and/or abutment member may be raised or lowered separately from each other. As shown in some embodiments, the ball ramp 23*d* may be telescoped and/or adjustable vertically relative to the abutment member 28 to create higher or lower passes to the shooter 1. A set screw 23*e* or other type of locking mechanism may be inserted into one or more openings between two telescoping members 23*f* to lengthen and/or shorten the relative length therebetween. This may create more or less dip or shooter's movement to the abutment member 28 depending on the relative pass height from the ramp. Further in some embodiments, the abutment member 28 may be adjustable upwardly and/or downwardly relative to the uprights and/or ramp. Although the raising and/or lowering of the ramp 23*d* and/or abutment member 28 is shown in detail in the drawings, it is merely representative of some embodiments, and it is to be understood that there are a variety of shapes, sizes, orientations, constructions, and quantities which may be used and still be within the scope of the teachings herein.

The ramp 23*d* may be positioned at various angles relative to the uprights 24 and/or net 42. In one embodiment as shown in FIG. 5, a pivoting pin 23*g* between the telescoping members of the curved ramp portion may allow the ramp to pivot. The ramp may be pivoted to a desired pivot angle and secured to maintain the position. The pivoting pin may allow the net 42 to be a different angles to adjust for close or far shots while maintaining a straight and/or tight net with the ball ramp 23*d* laying in the bottom thereof. Although pivoting pin is shown in detail in the drawings, it is merely representative of some embodiments, and it is to be understood that there are a variety of shapes, sizes, orientations, constructions, and quantities which may be used and still be within the scope of the teachings herein.

The adjustable rim members 39 may be used in various embodiments of the rim portion and/or floor portion. The rim members 30 may be separately attached or integrally attached to the basketball rim by one or more portions of the rim portion. One embodiment of the rim portion may include the rim members attached or connected to the basketball rim. Another embodiment may include the adjustable rim members attached by one or more portions of an arcuate body. While another embodiment may include portions of the arcuate body along with one or more portions of a funnel integrated with the rim members. In another embodiment an arcuate body along with a funnel and lower ring for arch correction may be integrated with the rim members. A further embodiment, may include the rim members with a body and depending attachments for the basketball return chute if used, with or without a funnel and/or lower ring. It is further understood that one or more portions of the floor portion, if used, may be used in various embodiments of the adjustable rim members. The uprights may be used in one embodiment of the floor portion. In another embodiment, the uprights may be used with or without the one or more of the alignment guide panels. Embodiments of the floor portion may or may not include the basketball racks. The abutment signal or structure may or may not be included in various embodiments of the floor portion as well.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A basketball shooting apparatus comprising:

a floor portion having a pair of uprights and one or more alignment guide panels, wherein said one or more alignment guide panels are adjustable in position relative to said pair of uprights;

a rim portion having an arcuate body and a pair of elongated rim members extending in a horizontal plane across an opening of a basketball rim and spaced from each other;

said pair of rim members are adjustable relative to each other to define a first position in said horizontal plane and a second position in said horizontal plane across an opening of a basketball rim, wherein each said rim member includes opposing ends;

wherein when in said first position, said opposing ends of each said rim member is secured to said arcuate body such that said pair of rim members are a first distance from each other in said horizontal plane and when in said second position said opposing ends of each said rim member is secured to said arcuate body such that said pair of rim members are a second distance from each other in said horizontal plane, and wherein said second distance is less than said first distance to vary an area of a basketball rim opening capable of receiving a basketball therethrough, and wherein said pair of elongated rim members are substantially parallel in said horizontal plane in both said first position and said second position; and wherein said uprights of said floor portion are substantially parallel to said pair of rim members in both said first position and said second position.

2. The basketball shooting apparatus of claim 1 further comprising a basketball return chute between said floor portion and said rim portion, and wherein said floor portion includes a spool to wind or unwind a portion of said basketball return chute.

3. The basketball shooting apparatus of claim 1 wherein said rim portion further includes at least one of a body, a funnel, a lower ring, or depending chute attachments.

4. The basketball shooting apparatus of claim 1 wherein said floor portion includes an abutment member between said uprights away from said rim portion whereby a basketball contacts said abutment member limiting downward basketball movement and the start of upward shooting motion and upward basketball movement.

5. The basketball shooting apparatus of claim 4 wherein said abutment member is adjustable upwardly or downwardly.

6. The basketball shooting apparatus of claim 4 wherein said abutment member is a flexible member.

7. The basketball shooting apparatus of claim 1 wherein said pair of rim members are flexible cords.

8. A basketball shooting apparatus for a basketball rim defining a rim opening comprising:

a floor portion having a pair of uprights and one or more alignment guide panels; and a rim portion having an arcuate body defining an opening in a first plane therein and a first rim member and a second rim member projecting into said opening and adjustable along a direction within said first plane, wherein said arcuate body includes a plurality of first attachments and a plurality of second attachments;

a basketball return chute between said floor portion and said rim portion, and wherein said floor portion includes a spool to wind or unwind a portion of said basketball return chute;

wherein each said first rim member and said second rim member includes opposing ends, wherein said first rim member includes an interior surface between said opposing ends and said second rim member includes an interior surface between said opposing ends and each of said interior surfaces face towards a central axis of said opening;

wherein each said first rim member and said second rim member is adjustable relative to each other along said direction in said first plane between a first position and a second position to vary the size of said opening that a basketball can pass therethrough;

wherein when in said first position, each opposing end of said first rim member and said second rim member are releasably secured to said plurality of first attachments of said arcuate body such that said first position said interior surface of said first rim member is a first distance from said interior surface of said second rim member wherein when in said second position, each opposing end of said first rim member and said second rim member are releasably secured to said plurality of second attachments of said arcuate body such that said interior surface of said first rim member is a second distance from said interior surface of said second rim member, wherein said first distance is larger than said second distance.

9. The basketball shooting apparatus of claim 8 wherein said pair of uprights are substantially parallel and wherein said interior surfaces are spaced in a substantially parallel orientation relative to each other, and said uprights are substantially parallel to said first rim member and said second rim member in both said first position and said second position.

10. The basketball shooting apparatus of claim 8 wherein said basketball return chute includes at least one of loops, ties, and eyes to secure to said floor portion at a variety of distances from the rim portion.

11. The basketball shooting apparatus of claim 8 wherein said rim portion further includes at least one of a funnel, a lower ring, or depending chute attachments.

12. The basketball shooting apparatus of claim 8 wherein said floor portion includes an abutment member between said uprights in a direction away from said rim portion whereby a basketball contacts said abutment member limiting downward basketball movement and the start of upward shooting motion and upward basketball movement.

13. The basketball shooting apparatus of claim 12 further comprising a ball ramp above said abutment member.

14. The basketball shooting apparatus of claim 13 wherein said ball ramp is adjustable upwardly and downwardly.

15. The basketball shooting apparatus of claim 13 wherein said ball ramp is pivotable relative to said abutment member.

16. The basketball shooting apparatus of claim 12 wherein said abutment member is adjustable upwardly and downwardly.

17. The basketball shooting apparatus of claim 12 wherein said abutment member is a flexible member.

18. The basketball shooting apparatus of claim 12 wherein said uprights angle towards said abutment member away from said rim portion.

19. The basketball shooting apparatus of claim 8 wherein said first rim member and said second rim member are one or more flexible cords.

20. A basketball shooting apparatus comprising:

a rim portion having an arcuate body defining an opening extending in a horizontal plane therein, said arcuate body having a pair of opposing elastic cords on opposing sides of a center plane, each said elastic cord includes opposing ends;

wherein said opposing elastic cords are adjustable relative to said center plane between a first position and a second position, when in said first position each respective said opposing end of each said elastic cord is secured to said arcuate body and define a first through opening between said elastic cords and opposing first circular sections between each respective said elastic cord and said arcuate body, when in said second position each respective said opposing end of each said elastic cord is secured to said arcuate body and define a second through opening between said elastic cord and opposing second circular sections between each respective said elastic cord and said arcuate body; and wherein said first though opening has a larger area to pass a basketball therethrough than said second through opening and correspondingly each said first circular section has a smaller area than each said second circular section.

21. The basketball shooting apparatus of claim 20 wherein said pair of opposing elastic cords are substantially parallel in at least one of said first position and said second position.

22. The basketball shooting apparatus of claim 20 wherein said rim portion is releasably secured to a basketball rim.

23. The basketball shooting apparatus of claim 20 wherein said arcuate body includes a plurality of attachments, wherein said opposing ends of said elastic cords are releasable secured to at least one of said plurality of attachments in either one of said first position or said second positions.

24. The basketball shooting apparatus of claim 20 further comprising a floor portion having a pair of uprights and one or more alignment guide panels and a basketball return chute between said floor portion and said rim portion.

25. The basketball shooting apparatus of claim 24 wherein said floor portion further includes an abutment member adjustable upwardly and downwardly relative to said uprights.

26. The basketball shooting apparatus of claim 25 wherein said uprights angle towards said abutment member away from said rim portion.

27. The basketball shooting apparatus of claim 20 wherein said rim portion includes at least one of a funnel projecting upwardly from said arcuate body of said rim portion, one or more depending attachments for a basketball return chute, or a lower ring interconnecting one or more portions of said arcuate body.

* * * * *